US010485339B2

(12) United States Patent
Hao et al.

(10) Patent No.: US 10,485,339 B2
(45) Date of Patent: Nov. 26, 2019

(54) RACK AND REFRIGERATION APPLIANCE

(71) Applicant: BSH HAUSGERAETE GMBH, Munich (DE)

(72) Inventors: Jingpeng Hao, Chuzhou (CN); Yantao Li, Chuzhou (CN); Junxin Liu, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/188,364

(22) Filed: Nov. 13, 2018

(65) Prior Publication Data

US 2019/0142156 A1 May 16, 2019

(30) Foreign Application Priority Data

Nov. 13, 2017 (CN) ..... 20171113094.3

(51) Int. Cl.

| | |
|---|---|
| ***A47B 96/04*** | (2006.01) |
| ***A47B 73/00*** | (2006.01) |
| ***F25D 25/02*** | (2006.01) |
| ***A47F 7/28*** | (2006.01) |

(52) U.S. Cl.

CPC ..... *A47B 73/008* (2013.01); *A47B 73/00* (2013.01); *A47F 7/28* (2013.01); *F25D 25/02* (2013.01); *F25D 2325/021* (2013.01); *F25D 2325/023* (2013.01)

(58) Field of Classification Search

CPC ..... A47B 73/00; A47B 73/008; A47B 81/04; A47B 19/04

USPC ..... 211/74, 75

See application file for complete search history.

(56) References Cited

U.S. PATENT DOCUMENTS

| | | | | |
|---|---|---|---|---|
| 4,515,334 A * | 5/1985 | Horne | A47B 73/00 211/74 |
| 6,454,108 B1 * | 9/2002 | Gerard | A47B 73/00 211/74 |
| 2004/0149668 A1 * | 8/2004 | Fann | A47B 73/002 211/74 |
| 2005/0211648 A1 * | 9/2005 | Haller | A47B 57/04 211/75 |

FOREIGN PATENT DOCUMENTS

| | | |
|---|---|---|
| CN | 2671427 Y | 1/2005 |
| CN | 201897358 U | 7/2011 |
| KR | 100771129 B1 | 10/2007 |
| WO | 2014207862 A1 | 12/2014 |

* cited by examiner

*Primary Examiner* — Matthew W Ing

(74) *Attorney, Agent, or Firm* — Laurence A. Greenberg; Werner H. Stemer; Ralph E. Locher

(57) ABSTRACT

A rack is provided for a refrigeration appliance. The rack includes a first support frame and a second support frame. The second support frame can move between a first position and a second position, and when the second support frame is at the first position, the first support frame and the second support frame form an accommodating portion extending from the first support frame to the second support frame and adapted to accommodating a bottle body in a lying state. When the second support frame moves to the second position, the second support frame supports a bottle neck located above the first support frame and is adapted to support the bottle body with a supporting portion supporting the bottle body in a tilted state.

9 Claims, 3 Drawing Sheets

RACK AND REFRIGERATION APPLIANCE

CROSS-REFERENCE TO RELATED APPLICATION

This application claims the priority, under 35 U.S.C. § 119, of Chinese application CN 201711113094.3, filed Nov. 13, 2017; the prior application is herewith incorporated by reference in its entirety.

BACKGROUND OF THE INVENTION

Field of the Invention

The present invention relates to a rack and a refrigeration appliance, and in particular, to a rack adapted to placing a bottle body and a refrigeration appliance having the rack, for example, a refrigerator and a wine cabinet.

An existing refrigerator is a refrigerating chamber of wine and beverages as well as a storage chamber of food. Usually, a rack is configured for a refrigerator to store wine or beverages.

Some bottled liquid food that is not completely used needs to be placed in a tilted state, such that an opening or a bottle mouth is at a relatively high level, to prevent liquid from flowing out. A rack is directly made to have a tilted surface but is inconvenient to horizontally place.

There is a foldable rack in the prior art. A leg of a support frame of the rack is usually inserted into an opening on a side surface of a rack frame, and the leg is used as a revolving shaft to control horizontal placement and tilted placement of the support frame through rotation, to implement horizontal placement and tilted placement of an article. However, a structure is unstable, and an operation is inconvenient.

SUMMARY OF THE INVENTION

One objective of the present invention is to provide a more stable rack and a refrigeration appliance having the rack.

To achieve the objective, one aspect of the present invention provides a rack. The rack according to an embodiment of the present invention includes a first support frame and a second support frame. The first support frame may be a first support portion or first support panel. The second support frame may be a second support portion or second support panel. The second support frame can be moved or is movable between a first position and a second position, and when the second support frame is at the first position, the first support frame and the second support frame form an accommodating portion extending from the first support frame to the second support frame and adapted to accommodating a bottle body in a lying state; and when the second support frame is moved or tilted or pivoted to the second position, the second support frame may be provided with a neck of the bottle located above the first support frame to be adapted to supporting the bottle body and a supporting portion making the bottle body in a tilted state.

When the first support frame and the second support frame form an accommodating portion extending from the first support frame to the second support frame, the first support frame and the second support frame are arranged in the same plane.

According to an aspect, a rack contains a first support frame and a second support frame. The second support frame is pivotable between a first position and a second position, and when the second support frame is in the first position, the second support frame is parallel to a horizontal plane. The first support frame and the second support frame form an accommodating portion extending from the first support frame to the second support frame and adapted to accommodating a bottle body in a lying state. When the second support frame is in the second position, the second support frame is vertical to the first support frame or forms an angle smaller than 90 degrees with the first support frame.

Different from a foldable rack in the prior art, the rack in this embodiment of the present invention fully utilizes different space when the bottle body is in the lying state and the tilted state to implement lying placement and tilted placement of the bottle body through position change of two support frames. Therefore, space utilization of the rack is more reasonable. When the bottle body needs to be placed in a lying state, the first support frame and the second support frame are both at the first position parallel to a horizontal plane and together form the accommodating portion adapted to accommodating the bottle body in the lying state. In addition, the second support frame for placing the bottle body in a tilted state is accommodated below the bottle body placed in a lying state. This does not affect horizontal placement of the bottle body and saves space, and clever hidden placement is more aesthetic. When the bottle body needs to be placed in a tilted state, the second support frame moves to the second position vertical to the first support frame or forming an angle less than 90 degrees with the first support frame. Therefore, space utilization of the rack is more reasonable, and a structure of the rack is more compact. User friendliness of the refrigeration appliance having the rack can be improved.

Preferably, when the second support frame is at the first position, the second support frame is parallel to a horizontal plane; and when the second support frame is at the second position, the second support frame is vertical to the first support frame or forms an angle smaller than 90 degrees with the first support frame.

Preferably, the first support frame and the second support frame are disposed in a front-rear direction, and the supporting portion is located at a first end, close to the first support frame, of the second support frame. In this way, the supporting portion can provide a sufficient height for the bottle body to be placed in a tilted state at the second position.

Preferably, when the second support frame is at the first position, a first end of the first support frame is close to or connected to the first end of the second support frame. When the second support frame is horizontally placed or is parallel to the horizontal plane, the first end of the first support frame and the first end of the second support frame are close or are close to form an integrity, for the bottle body to be placed in a lying state.

Preferably, the rack includes a frame body, the first support frame being fixed into the frame body, and the second support frame being rotatably connected to the frame body. It should be noted that the first support frame in this embodiment of the present invention can be installed on the frame body, or two side edges of the first support frame can be extended, such that the second support frame can be rotatably connected to the side edges of the first support frame. Therefore, in this case, the first support frame and the frame body are integrally designed.

Preferably, the rack includes a positioning apparatus for fixing the second support frame to the second position.

Preferably, the second support frame is connected to the frame body via a revolving shaft; and the positioning apparatus is a nut for controlling the revolving shaft to rotate, and rotation of the revolving shaft is controlled by fastening or unfastening the nut, such that the second support frame is maintained at the first position or the second position.

Preferably, the second support frame is connected to the frame body via a revolving shaft; and the positioning apparatus is a turning member rotatably installed on the frame body, where when the second support frame is at the first position, the turning member is located below the second support frame. When the second support frame is turned to the second position, the turning member moves upwards and supports the second support frame to maintain the second support frame at the second position. The turning member helps provide stability of the second support frame. In addition, when the support frame does not need to be used in a tilted state, a user may selectively idly place the second support frame beyond a range of the accommodating portion, to avoid occupying space of the rack by the support frame or disturbing the user. Therefore, user friendliness of the refrigeration appliance having the rack is improved.

Preferably, a rotating shaft of the turning member is located between the first end of the second support frame at the first position and the revolving shaft.

Preferably, the first end of the first support frame includes a support block lower than the accommodating portion, to support the first end of the second support frame at the first position. In a preferred embodiment, the first end of the second support frame may be directly supported on the support block. In an alternative embodiment, the second support frame is set up on the positioning apparatus (such as the turning member) to be indirectly supported on the support block.

Preferably, the supporting portion includes a groove located at the first end of the second support frame to be adapted to supporting the neck of the bottle body. In this case, the bottle body can be placed in a tilted state and is secure and stable.

Preferably, a stop portion for limiting forward movement of the bottle body is included, and the stop portion is disposed at a front end of the rack.

Preferably, the first support frame and the second support frame are of wooden structures. Alternatively, the first support frame and the second support frame may be made of other materials such as plastics and metals and are made into spacing bars or other patterns, ensuring that the bottle body does not roll when horizontally placed.

Another aspect of the present invention provides a refrigeration appliance, including the rack according to any one of the preceding claims.

Problems in the prior art that the rack has an unstable structure and is inconvenient to operate are resolved according to the present invention, and the rack provided in the present invention can implement horizontal and tilted placement of the bottle body, operations are simple, and a whole structure is more stable and aesthetic.

Other features which are considered as characteristic for the invention are set forth in the appended claims.

Although the invention is illustrated and described herein as embodied in a rack and a refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the accompanying drawings: 1: rack, 2: first support frame, 3: second support frame, 4: accommodating portion, 5: supporting portion, 6: positioning apparatus, 7: turning member, 8: support block, 9: stop block, 10: frame body.

The present invention is described in detail below with reference to the accompanying drawings and in combination with the embodiments. It should be noted that in a case of no conflict, the embodiments in this application and features in the embodiments can be mutually combined.

Figure 1:
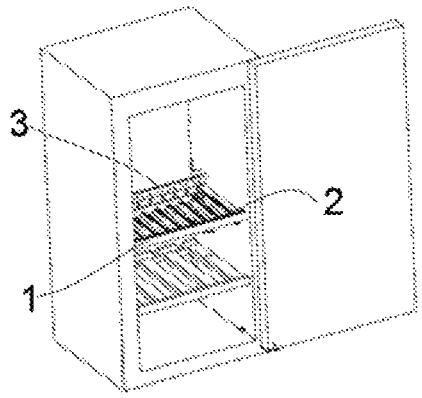
FIG. 1 is a diagrammatic, perspective view of a rack is located within a refrigerator.
Figure 2:
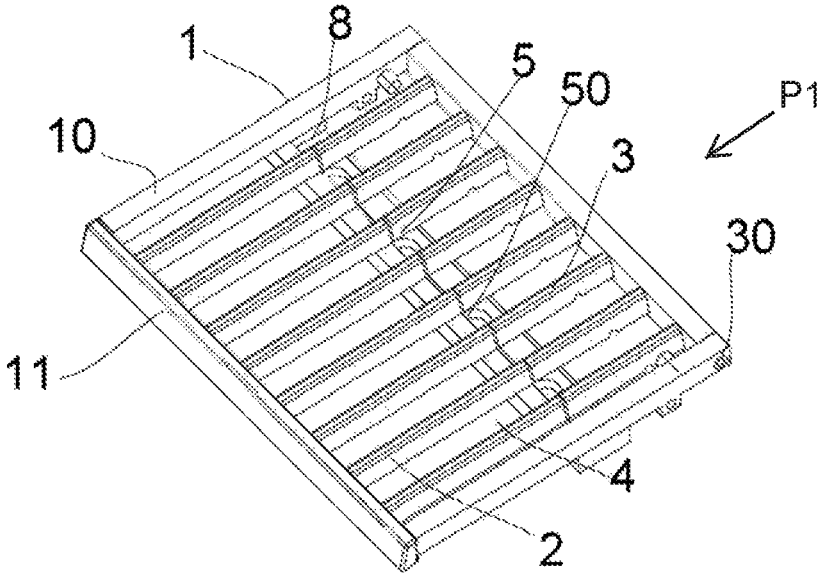
FIG. 2 is a perspective view of a second support frame which is located at a first position.
Figure 3:
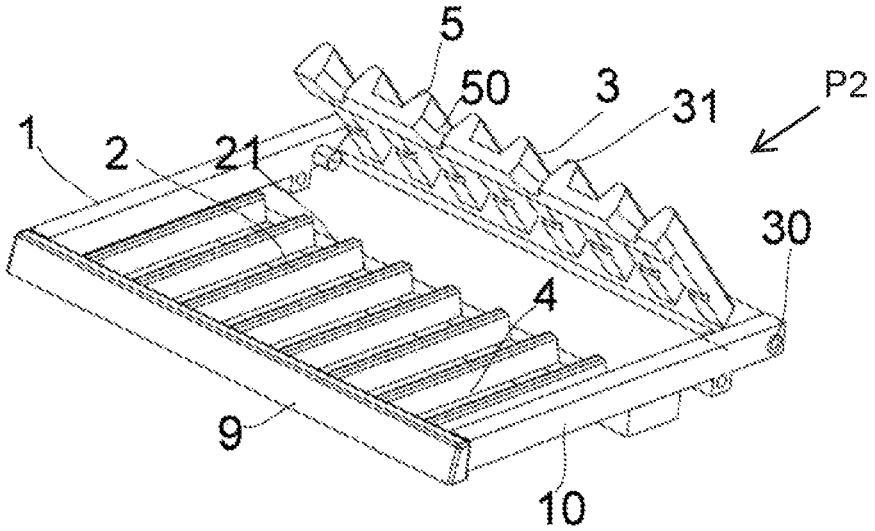
FIG. 3 is perspective view of the second support frame which is located at a second position.
Figure 4:
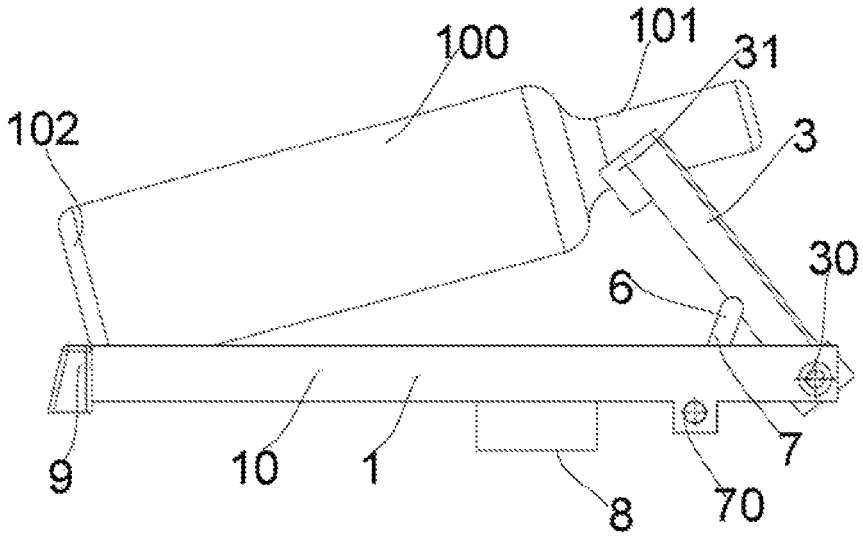
FIG. 4 is a side view of when a bottle body is placed in a tilted state.
Figure 5:
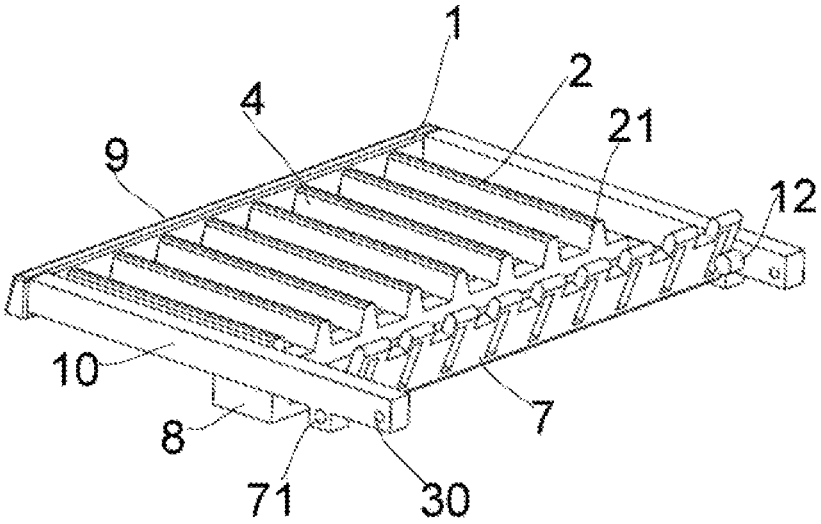
FIG. 5 is a perspective view of a turning member.

This embodiment provides a rack 1, the rack 1 is usually used to place wine or bottled beverages, and the rack 1 can be placed within a refrigeration appliance (for example, a refrigerator or a wine cabinet). FIG. 1 is a schematic diagram showing that the rack 1 is located within a refrigerator; FIG. 2 is a schematic diagram when a second support frame 3 is located at a first position; FIG. 3 is a schematic diagram when the second support frame 3 is located at a second position; FIG. 4 is a schematic diagram when a bottle body is placed in a tilted state; and FIG. 5 is a schematic structural diagram of a turning member 7.

As shown in FIG. 1, the rack 1 includes the first support frame 2 and the second support frame 3. The first support frame 2 and the second support frame 3 may be both of wooden structures. In other embodiments, the first support frame 2 and/or the second support frame 3 may be made of other materials such as plastics and metals and are made into spacing bars or other patterns, ensuring that a bottle body 100 does not roll when horizontally placed.

The second support frame 3 can move between a first position P1, FIG. 2, and a second position P2, FIG. 3. In this embodiment, when the second support frame 3 is at the first position P1, the second support frame 3 is parallel to a horizontal plane. When the second support frame 3 is at the second position P2, the second support frame 3 is vertical to the first support frame 2 or forms an angle smaller than 90 degrees with the first support frame 2.

When the second support frame 3 is at the first position, the first support frame 2 and the second support frame 3 form an accommodating portion 4 extending from the first support frame 2 to the second support frame 3 and adapted to accommodating the bottle body 100 in a lying state. When the second support frame 3 moves to the second position, the second support frame 3 supports a bottle neck 101 located above the first support frame 2 to be adapted to supporting the bottle body 100 and a supporting portion 5 making the bottle body 100 in a tilted state.

Different from a foldable rack in the prior art, the rack in this embodiment fully utilizes different space when the bottle body is in the lying state and the tilted state to implement lying placement and tilted placement of the bottle body through position change of two support frames. Therefore, space utilization of the rack is more reasonable. When the bottle body 100 needs to be placed in a lying state, the first support frame 2 and the second support frame 3 are both at the first position P1 parallel to the horizontal plane and together form the accommodating portion 4 adapted to accommodating the bottle body 100 in the lying state. In addition, the second support frame 3 for placing the bottle body 100 in a tilted state is accommodated below the bottle body 100 placed in a lying state. This does not affect horizontal placement of the bottle body 100 and saves space, and clever hidden placement is more aesthetic. When the bottle body 100 needs to be placed in a tilted state, the second support frame 3 moves to the second position P2 vertical to the first support frame 2 or forming an angle less than 90 degrees with the first support frame 2. Therefore, space utilization of the rack is more reasonable, and a structure of the rack is more compact.

Specifically, the first support frame 2 and the second support frame 3 are disposed in a front-rear direction. The second support frame 3 is located at a rear portion of the first support frame 2.

The supporting portion 5 is located at a first end 31, close to the first support frame 2, of the second support frame 3. At the second position, the first end of the second support frame 3 is wrapped upward. In this way, the supporting portion 5 can provide a sufficient height for the bottle body 100 to be placed in a tilted state at the second position.

When the second support frame 3 is at the first position P1, a first end 21 of the first support frame 2 is close to or connected to the first end 31 of the second support frame 3. When the second support frame 3 is horizontally placed or is parallel to the horizontal plane, the first end 21 of the first support frame 2 and the first end 31 of the second support frame 3 are close or are close to form an integrity, for the bottle body 100 to be placed in a lying state.

When the second support frame 3 is located at the second position P2, the bottle body 100 is placed on the second support frame 3 in a tilted state, a bottom 102 of the bottle body 100 can be supported on the first support frame 2, and the neck 101 of the bottle body is placed on the supporting portion 5. Preferably, the supporting portion 5 includes a groove 50 located at the first end 31 of the second support frame 3 to be adapted to supporting the neck 101 of the bottle body 100. In this case, the bottle body can be placed in a tilted state and is secure and stable.

In addition, a stop portion 9 for limiting forward movement of the bottle body may be disposed at a front end 11 of the rack 1 and provides sufficient support for the bottom 102 of the bottle body.

In this embodiment, the rack 1 may include a frame body 10, the first support frame 2 being fixed into the frame body 10. The second support frame 3 is rotatably connected to the frame body 10. The second support frame 3 is connected to the frame body 10 via a revolving shaft 30 or is directly connected to two side edges 22 of the first support frame 2.

It should be noted that the first support frame 2 in this embodiment can be installed on the frame body 10, or two side edges of the first support frame 2 can be extended, such that the second support frame 3 can be rotatably connected to the side edges of the first support frame 2. Therefore, in this case, the first support frame 2 and the frame body 10 are integrally designed.

To better maintain the second support frame at the second position P2, the rack 1 includes a positioning apparatus 6 for fixing the second support frame 3 to the second position P2.

In a solution, the positioning apparatus 6 is a nut for controlling the revolving shaft 30 to rotate, and rotation of the revolving shaft 30 is controlled by fastening or unfastening the nut, such that the second support frame 3 is maintained at the first position P1 or the second position P2.

In this embodiment, as shown in FIG. 4 and FIG. 5, the positioning apparatus 6 is a turning member 7 rotatably installed on the frame body 10. When the second support frame 3 is at the first position P1, the turning member 7 is located below the second support frame 3. When the second support frame 3 is turned to the second position P2, the turning member 7 moves upwards and supports the second support frame 3 to maintain the second support frame 3 at the second position P2.

When the bottle body 10 is horizontally placed, the turning member 7 and the second support frame 3 are both located below the bottle body 100, to avoid occupying space of the rack or disturbing the user. When the bottle body 100 is placed in a tilted state, the turning member 7 provides stable support to maintain the second support frame 3 at the second position P2. In addition, a limit block 12 may be provided to limit rotation of the turning member 7, to ensure that the turning member 7 stably supports the second support frame 3. Preferably, a rotating shaft 70 of the turning member 7 is located between the first end 31 of the second support frame 3 at the first position and the revolving shaft 30. Therefore, user friendliness of the rack having the turning member 7 is improved.

Preferably, the first end 21 of the first support frame 2 includes a support block 8 lower than the accommodating portion 4, to support the first end 31 of the second support frame 3 at the first position. The first end 31 of the second support frame 3 may be directly supported on the support block 8. In an alternative embodiment, the second support frame 3 may be set up on the positioning apparatus 6 to be indirectly supported on the support block 8.

As shown in FIG. 4 and FIG. 5, at the first position P1, the first end 31 of the second support frame 3 and the turning member 7 are supported on the support block 8 of the first end 31 of the first support frame 3. The support block 8 provides support to ensure that the first end 31 of the second support frame 3 and the turning member 7 are stably placed on the horizontal plane.

Various specific implementations described in the above and shown in the accompanying drawings are only used for illustrating the present invention, and are not the entirety of the present invention. Within the scope of the basic technical idea of the present invention, any type of modifications for the present invention made by persons ordinarily skilled in the art falls within the protection scope of the present invention.

The invention claimed is:

1. A rack, comprising:

a first support frame;

a second support frame, said second support frame being moved between a first position and a second position, and when said second support frame is in the first position, said first support frame and said second support frame forming an accommodating portion extending from said first support frame to said second support frame and adapted to accommodating a bottle body in a lying state;

when said second support frame is in the second position, said second support frame being provided with a bottle neck of the bottle body disposed above said first support frame and is adapted to supporting the bottle body, said second support frame having a supporting portion supporting the bottle body in a tilted state;

a frame body, said first support frame being fixed into said frame body, and said second support frame being rotatably connected to said frame body;

a positioning apparatus for fixing said second support frame to the second position;

a revolving shaft, said second support frame is connected to said frame body by said revolving shaft; and said positioning apparatus is a nut for controlling said revolving shaft to rotate, and rotation of said revolving shaft is controlled by fastening or unfastening said nut, such that said second support frame is maintained at the first position or the second position.

2. The rack according to claim 1, wherein:

when said second support frame is at the first position, said second support frame is parallel to a horizontal plane; and when the second support frame is at the second position, the second support frame is vertical to the first support frame or forms an angle smaller than 90 degrees with the first support frame.

3. The rack according to claim 1, wherein said first support frame and said second support frame are disposed in a front-rear arrangement, and said supporting portion is disposed at a first end of said second support frame, adjacent to said first support frame.

4. The rack according to claim 1, wherein when said second support frame is at the first position, a first end of said first support frame is adjacent to or connected to a first end of said second support frame.

5. The rack according to claim 1, wherein said first support frame has a first end with a support block lower than said accommodating portion, to support a first end of said second support frame at the first position.

6. The rack according to claim 1, wherein said supporting portion has a groove formed therein and disposed at a first end of said second support frame to be adapted to supporting the bottle neck of the bottle body.

7. A refrigeration appliance, comprising:

the rack according to claim 1.

8. A rack, comprising:

a first support frame;

a second support frame, said second support frame being moved between a first position and a second position, and when said second support frame is in the first position, said first support frame and said second support frame forming an accommodating portion extending from said first support frame to said second support frame and adapted to accommodating a bottle body in a lying state;

when said second support frame is in the second position, said second support frame being provided with a bottle neck of the bottle body disposed above said first support frame and is adapted to supporting the bottle body, said second support frame having a supporting portion supporting the bottle body in a tilted state;

a frame body, said first support frame being fixed into said frame body, and said second support frame being rotatably connected to said frame body;

a positioning apparatus for fixing said second support frame to the second position;

a revolving shaft, said second support frame is connected to said frame body by said revolving shaft; and said positioning apparatus is a turning member rotatably installed on said frame body, when said second support frame is at the first position, said turning member is disposed below said second support frame; and when said second support frame is turned to the second position, said turning member moves upwards and supports said second support frame to maintain said second support frame at the second position.

9. The rack according to claim 8, wherein said turning member has a rotating shaft disposed between a first end of said second support frame at the first position and said revolving shaft.

* * * * *